United States Patent [19]

Tiffin et al.

[11] 4,016,688

[45] Apr. 12, 1977

[54] EXTENSIBLE CRANE BOOM STRUCTURE

[75] Inventors: Joseph B. Tiffin; Daniel G. Quinn; Evart J. Vroonland, all of Cedar Rapids, Iowa

[73] Assignee: FMC Corporation, San Jose, Calif.

[22] Filed: May 27, 1975

[21] Appl. No.: 581,172

[52] U.S. Cl. ..... 52/118; 52/115; 52/731; 212/55; 212/144; 214/141

[51] Int. Cl.[2] ..... B66C 23/04

[58] Field of Search ..... 182/2; 212/55, 144; 214/141; 403/295, 335; 138/171, 158, 168; 52/731, 630, 692, 695, 632, 118, 738, 114, 740, 115, 117, 730

[56] References Cited

UNITED STATES PATENTS

| | | | |
|---|---|---|---|
| 755,436 | 3/1904 | Bental | 29/477 |
| 854,947 | 5/1907 | Hill | 52/731 |
| 1,331,412 | 2/1920 | Brown | 52/731 |
| 1,472,897 | 1/1923 | Anderson | 52/298 |
| 1,552,474 | 9/1925 | Dornier | 52/731 X |
| 1,579,134 | 3/1926 | Nusbaum | 160/38 |
| 1,656,871 | 1/1928 | Schnitzer | 52/731 X |
| 1,680,538 | 8/1928 | Gross | 52/619 |
| 1,761,037 | 6/1930 | Gross | 52/619 |
| 1,785,025 | 12/1930 | Felsenthal | 52/619 |
| 1,820,660 | 8/1931 | Gilbert | 52/731 |
| 1,959,756 | 5/1934 | Ferm | 138/157 |
| 1,994,716 | 3/1935 | Klemperer | 52/731 X |
| 2,039,886 | 5/1936 | Cohn | 138/75 |
| 2,170,019 | 8/1939 | Gaylord | 219/10 |
| 2,308,565 | 1/1943 | Mitchell | 29/155 |
| 2,313,897 | 3/1943 | Selberg | 189/15 |
| 2,518,251 | 8/1950 | Quayle | 187/9 |
| 2,521,351 | 9/1950 | Dimmendaal | 138/81 |
| 2,554,930 | 5/1951 | Ulinski | 214/113 |
| 2,632,530 | 3/1953 | Wagner | 403/295 |
| 2,632,535 | 3/1953 | Clerk | 403/295 |
| 2,666,417 | 1/1954 | Harsch | 121/46 |
| 2,684,159 | 7/1954 | Oldenkamp | 212/55 |
| 2,701,031 | 2/1955 | Brumbaugh | 187/9 |
| 2,788,863 | 4/1957 | Ulinski | 187/9 |
| 2,819,803 | 1/1958 | Obenchain | 212/55 |
| 2,888,300 | 5/1959 | Curtis et al. | 308/3 |
| 2,896,750 | 7/1959 | Eitel | 212/55 |
| 2,911,111 | 11/1959 | Grove | 212/55 |
| 2,912,013 | 11/1959 | Freyholdt et al. | 138/75 |
| 2,934,372 | 4/1960 | Jewell et al. | 296/28 |
| 2,949,201 | 8/1960 | MacAlpine et al. | 214/657 |
| 2,962,133 | 11/1960 | Kivett et al. | 52/580 |
| 2,984,373 | 5/1961 | Przybylski | 214/141 |
| 3,002,235 | 10/1961 | Fountain | 20/11 |
| 3,077,171 | 2/1963 | Gotsch et al. | 113/120 |
| 3,104,454 | 9/1963 | Handley et al. | 29/155 |
| 3,154,199 | 10/1964 | Balogh et al. | 212/55 |
| 3,184,263 | 5/1965 | Plegot | 52/630 X |
| 3,243,052 | 3/1966 | Grove | 212/55 |
| 3,263,386 | 8/1966 | Kimmel | 52/580 |
| 3,270,899 | 9/1966 | Brown et al. | 214/75 |
| 3,315,821 | 4/1967 | Grove | 212/55 |
| 3,386,594 | 6/1968 | Grove | 212/55 |
| 3,396,852 | 8/1968 | Balogh | 212/35 |
| 3,398,645 | 8/1968 | Nansel | 91/173 |
| 3,423,890 | 1/1969 | Leigh | 52/731 X |
| 3,425,726 | 2/1969 | Muller | 403/219 |
| 3,426,917 | 2/1969 | Siegel | 212/55 |
| 3,445,004 | 5/1969 | Grider et al. | 212/55 |
| 3,620,579 | 11/1971 | Brown et al. | 308/3 R |
| 3,690,742 | 9/1972 | Sung | 212/55 |
| 3,708,937 | 1/1973 | Sterner | 52/118 |
| 3,890,757 | 6/1975 | Lamer et al. | 52/695 |

FOREIGN PATENTS OR APPLICATIONS

| | | | |
|---|---|---|---|
| 451,735 | 4/1913 | France | 138/157 |
| 861,918 | 1/1953 | Germany | 52/632 |
| 1,009,373 | 5/1957 | Germany | 212/55 |
| 368,680 | 2/1939 | Italy | 52/630 |
| 817,379 | 7/1959 | United Kingdom | 138/157 |

*Primary Examiner*—Leslie Braun
*Attorney, Agent, or Firm*—J. W. Edwards; J. F. Verhoeven; C. E. Tripp

[57] ABSTRACT

An extensible cantilever boom assembly, for a mobile crane, has telescopically interfitting box-like boom sections, that include web or side plates of uniform thickness. These plates are shaped to provide increased stiffness, and openings are provided within some of the plates to reduce the plate weight, so that the load carrying capacity of the boom is increased. A plurality of shaped portions are formed within the plates, at locations intermediate the top edges and the bottom edges of the plates. These plate portions are spaced laterally from the parallel planes that define the side surfaces of the plates, at the junctures of the side surfaces with the top and bottom edges. The shaped portions, located at longitudinally spaced intervals, are aligned in a row that extends longitudinally of the plate. Each shaped portion has a regular geometrical pattern that forms a laterally projecting protuberance on one side of the plate and a corresponding depression on the opposite side of the plate.

4 Claims, 6 Drawing Figures

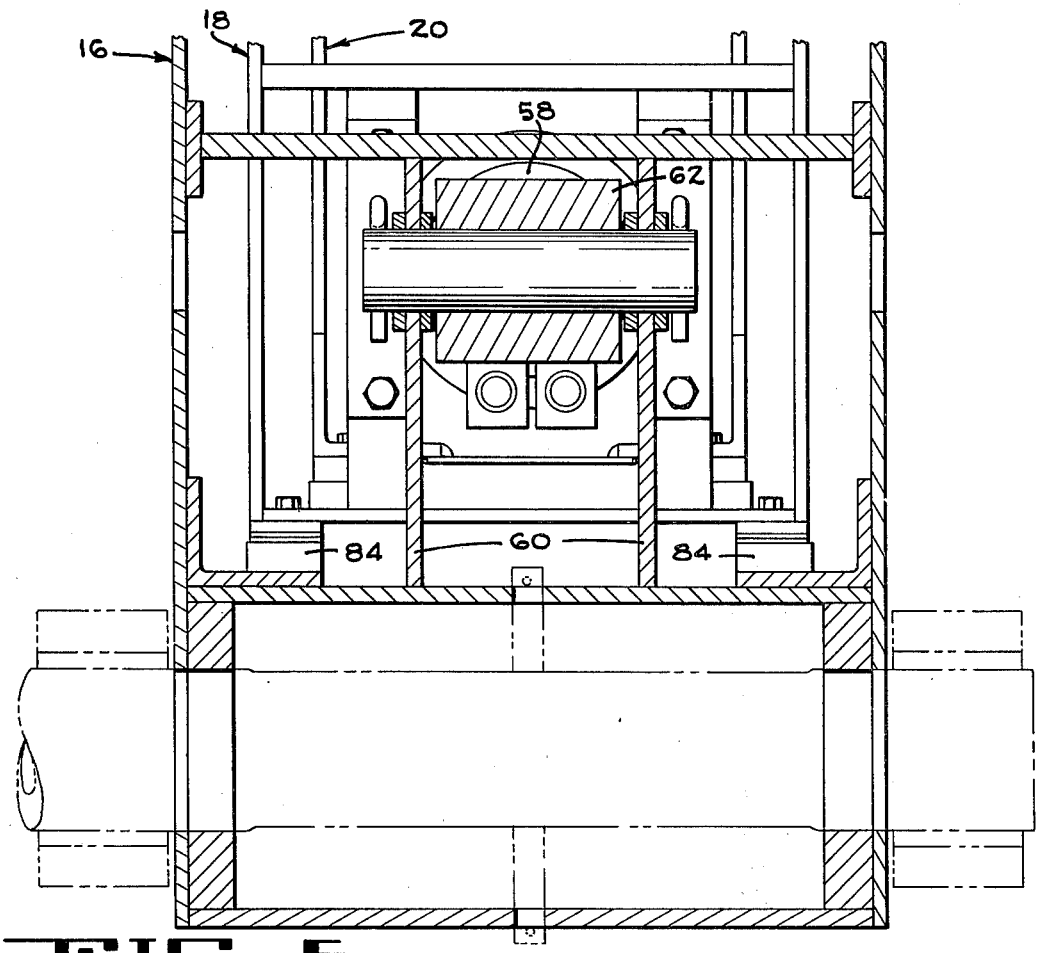
FIG_5
FIG_6
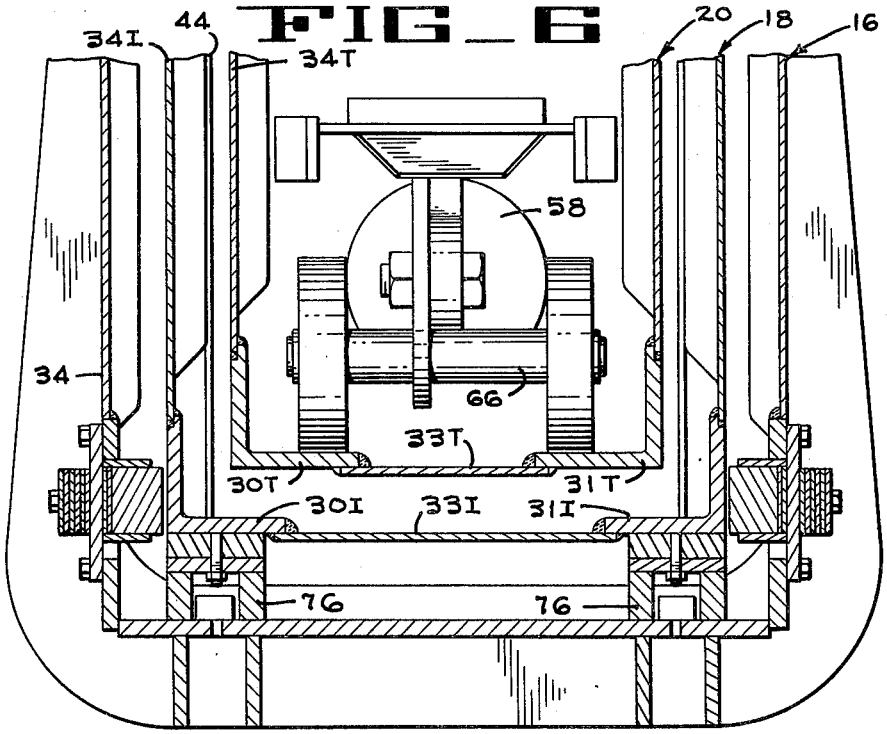

EXTENSIBLE CRANE BOOM STRUCTURE

BACKGROUND OF THE INVENTION

This invention relates to a crane boom structure and more specifically to a web plate within such boom structure.

Description of the Prior Art

When designing a crane boom it is desirable to develop as great a load carrying capacity as possible within certain size limitations. The boom must support both the load being lifted and the weight of the boom itself. Thus, the boom section should provide maximum strength for the weight of material used. When the boom assembly is extensible and mounted as a cantilever, greater stresses are developed within the boom sections. Furthermore, the telescoping boom sections are subjected to concentrated reactions, at the contact points between boom sections, and some of these contact points can vary in location along the length of the boom, as the sections are extended and retracted. Web or side plates, within the boom sections, must be able to resist buckling, at the contact points, under such concentrated loading.

U.S. Pat. No. 3,620,579 discloses a truck mounted cantilever boom assembly having a plurality of telescopic boom sections. Each boom section has four right angle corner members that are held in spaced relationship by top, bottom and side plates of smaller thickness than the corner members, to form a generally box-like section. This construction places the greatest amount of metal, in the corners of the boom section, where it offers the greatest resistance to bending forces and to torsion forces. The web or side plates must be thick enough to resist buckling due to shear forces acting both horizontally and vertically on the plates. The web or side plates are made of metal having a uniform thickness.

U.S. Pat. Nos. 2,684,159 and 3,157,288 disclose spaced openings within the web or side plates of an extensible boom, to lighten the boom and to provide access to the interior of the boom for servicing. It is also known that booms of a lattice construction, such as shown in U.S. Pat. No. 3,426,917, provide great strength for a given weight. Thus, it is desirable to remove unnecessary portions of metal, in the web or side plates, to lighten the boom.

Design considerations for beams and girders having openings within the webs thereof are discussed in Section 4.7 of "Design of Welded Structures" by Omer W. Blodgett, James F. Lincoln Arc Welding Foundation, Cleveland, Ohio, 1966. Web buckling can be a problem when the load supporting web is thin and has openings therein.

SUMMARY OF THE INVENTION

A crane boom structure includes an elongated web plate of uniform thickness, that is shaped to provide increased stiffness to resist buckling. The web plate has a top edge, a bottom edge and, a pair of side surfaces. These surfaces are located in spaced apart parallel planes at the junctures of the side surfaces with said top and bottom edges; a plurality of shaped portions are formed within the web plate, at locations intermediate the top and bottom edges, to space those portions of the web plate laterally from said parallel planes. The shaped portions, located at spaced intervals, are aligned in a row that extends longitudinally of the web plate. Each shaped portion has a regular geometrical pattern that forms a laterally projecting protuberance on one side of the web plate and a corresponding depression on the opposite side of the web plate.

In a preferred form of the invention, the shaped portions have interior panels that are offset from, and parallel with, the spaced apart parallel planes, in which the side edges are located at the junctures thereof with the top and bottom edges of the web plate. Central openings are provided, within the interior panels, to reduce the weight of the web plate. The web plate is stiffened by the shaped portions, primarily to resist buckling, and lightened by the openings therein. The portion of the web plate remaining between adjacent shaped portions transfers stress between the top and bottom edges of the web plate. The shaped portion's size and shape, the center to center spacing between shaped portions, the edge distance from a shaped portion to an edge joint weld along either the top or bottom edge of the web plate, and the interior panel flange width to the central opening, all provide for strengthening a thin plate, to serve as a web plate that is capable of resisting buckling.

The web plate is particularly suitable for use in an extensible crane boom assembly having telescopically interfitting boom sections. Each boom section is formed by four elongated angle chords, having normally disposed flanges that are positioned to define the longitudinal corner edges of a box-like configuration, and by elongated plates, that extend between adjacent angle chords to form the sides, top and bottom of the boom section. The web plates that are used for the side plates of the boom sections are made of high formability steel. Such steel facilitates forming the shaped portions within the plates, and also, provides the boom sections with very good post-elastic strength characteristics. If the elastic limit is exceeded, the plate will bend, but the boom will not collapse. The arrangement of the angle chords with the thin plates places the steel at the extreme corners of the boom to yield a maximum strength with a minimum weight. The angle chords have sufficient rigidity to spread the local shoe reactions over a large area, thereby eliminating high weld stresses due to such loads. The critical welds are not located at the corners of the boom, but spaced inwardly therefrom, at the ends of the angle chord flanges and the plates.

BRIEF DESCRIPTION OF THE DRAWING

FIG. 5 is a section, taken on the line 5—5 of FIG. 4.

FIG. 6 is a section, taken on the line 6—6 of FIG. 4.

DESCRIPTION OF THE PREFERRED EMBODIMENT

Figure 1:
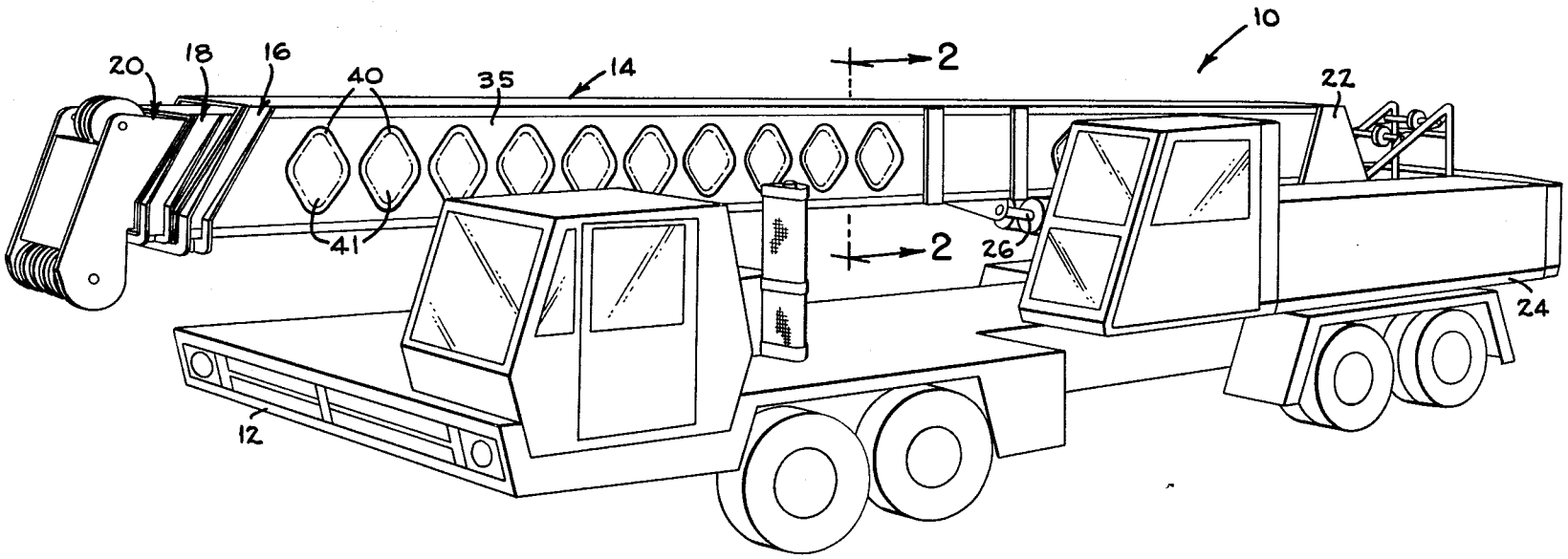
FIG. 1 is a perspective view of a mobile crane having an extensible cantilever boom assembly that embodies the present invention.

With reference to FIG. 1, a mobile crane 10 is mounted upon a truck type carrier 12. The crane has an extensible boom assembly 14 that includes telescopically interfitting boom sections 16, 18 and 20. While any number of boom sections could be used, as required by the particular boom design, the three boom sections shown are representative of an extensible boom. The boom section 16 fits about the other boom sections, and this section forms a base for the boom assembly. Slidably fitted within the base boom section is the intermediate boom section 18 and the tip boom section 20 is slidably fitted within the intermediate boom section. One end of the base boom section is pivotally connected within a mounting frame 22 that rests upon an upper machinery platform 24. An extensible strut 26, for elevating the boom assembly, has one end pivotally connected to the base boom section, at a point spaced from the mounting frame, and the other end of the strut is pivotally connected to the upper machinery platform. This platform rotates in a generally horizontal plane above the carrier.

Figure 2:
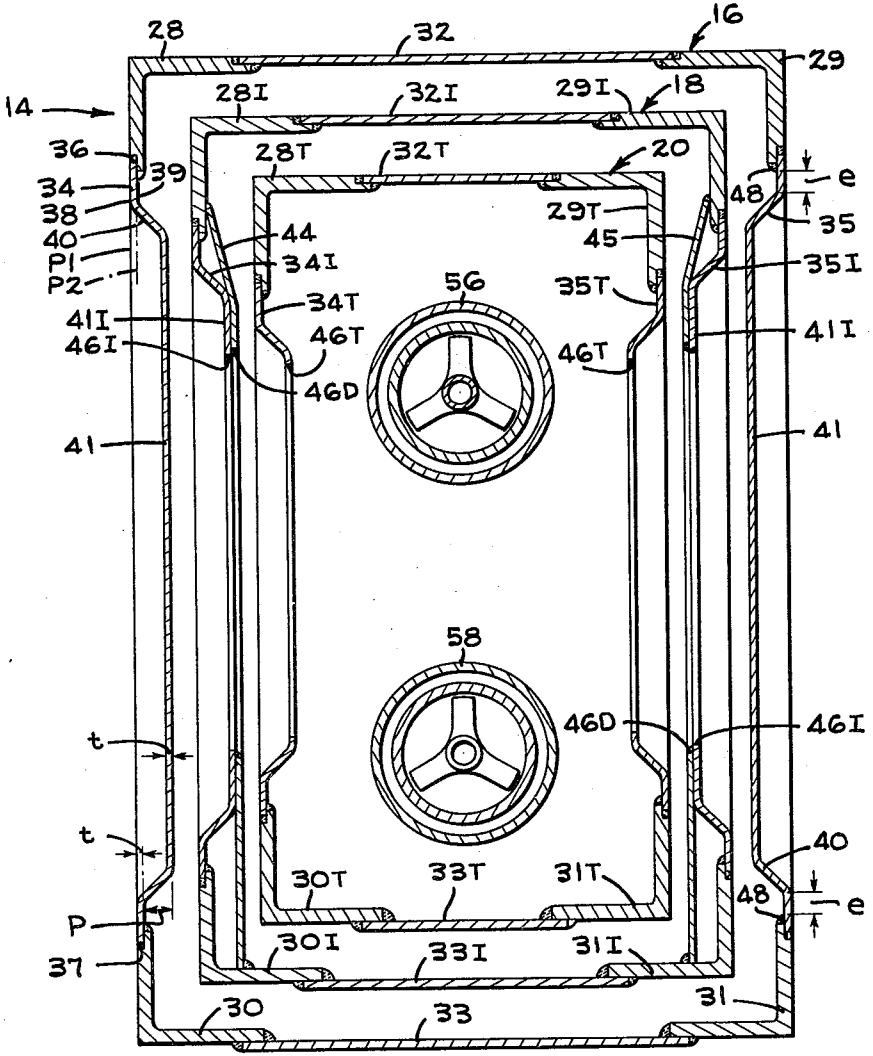
FIG. 2 is an enlarged transverse section of the boom assembly, taken on the line 2—2 of FIG. 1.

Looking now at FIG. 2, the base boom section 16 has a generally rectangular cross section that surrounds the intermediate boom section 18, which in turn encloses the top boom section 20. The corners of the base boom section are formed by angle chords 28, 29, 30 and 31 that have normally disposed flanges, extending, both horizontally and vertically. Each angle chord forms one corner of the rectangular cross section, and extends longitudinally of the boom section, to define a longitudinal corner edge thereof. A top cover plate 32 extends horizontally between the top angle chords 28 and 29, and this plate is welded thereto, within step recesses in the horizontal flanges of the angle chords. A bottom cover plate 33 extends horizontally between the bottom angle chords 30 and 31 and this plate is welded to the horizontal flanges of the bottom chords in an underlapping relationship. A web or side plate 34 extends in a generally vertical manner, between the vertical flanges of angle chords 28 and 30, and a web or side plate 35 extends in a corresponding manner, between angle chords 29 and 30. The webs or side plates 34 and 35 fit within step recesses in the vertical flanges of the angle chords and are welded thereto.

The elongated web or side plate 34 has a top edge 36, a bottom edge 37 and a pair of side surfaces 38 and 39. These surfaces are located in spaced apart parallel planes P1 and P2, at the junctures of the side surfaces with the top and bottom edges. The plate has a substantially uniform thickness corresponding to the spacing of the parallel planes. Shaped portions 40 are formed within the plate, at a location intermediate the top and bottom edges, to space those portions of the plate, laterally from the parallel planes, and inwardly of the base boom section 16.

The shaped portions 40, located at spaced intervals, are aligned in a row that extends longitudinally of the webs or side plates 34 and 35, as shown in FIG. 1. Each shaped portion has a regular geometrical pattern that is basically a frustum of a pyramid having a generally diamond-shaped base. The corners of the diamond are rounded to allow stresses to flow, rather than ending at sharp junctures of diamond shaped openings, and to give a pleasing appearance. The diamond-shaped base is oriented with the major axis of the diamond perpendicular to the longitudinally extending row of shaped portions and, in the same plane therewith. The shaped portions taper inwardly of the boom section 16 from the parallel planes P1 and P2. Each shaped portion has an interior panel 41, as shown in FIG. 2, that is offset from, and parallel with, the spaced apart parallel planes. Thus, each shaped portion forms a laterally projecting protuberance, on the side surface 39 of the plate, and a corresponding depression, on the opposite side surface 38 of the plate. By spacing a portion of the plate laterally from the parallel planes, the plate is stiffened to resist buckling. The lateral projection P of the shaped portions should be a distance sufficient to provide good buckling resistance. For a web plate having a thickness of 3/16 of an inch and a depth of up to 29½ inches, a projection distance P of about 1 inch has been found to be satisfactory.

Figure 3:
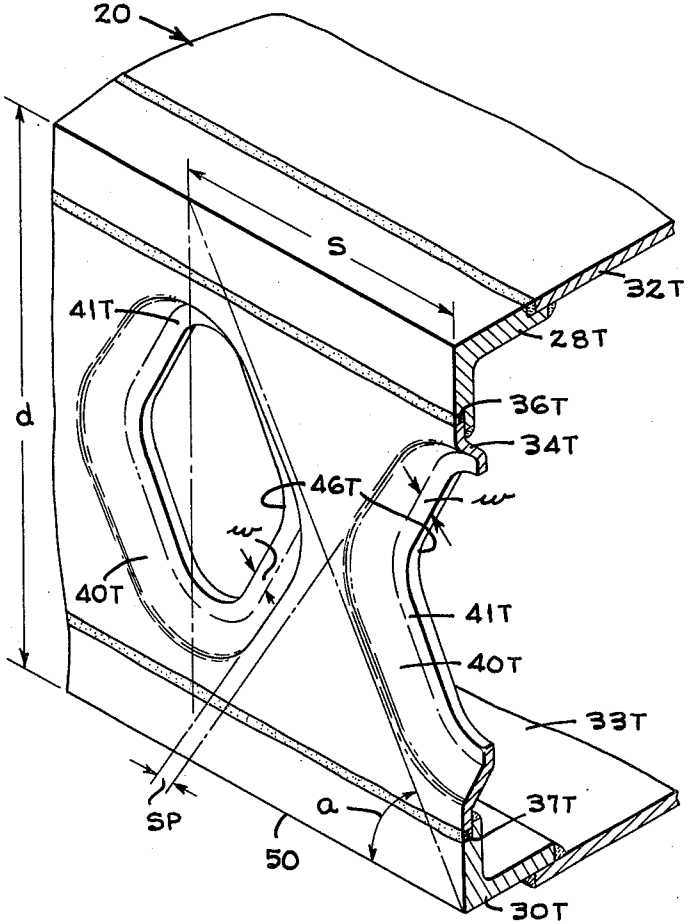
FIG. 3 is a fragmentary, perpsective view of a portion of a boom section, illustrating the shaped portions in the web or side plate.

The web or side plate 35, on the opposite side of the base boom section 16, is identical in comparison with the plate 34. The intermediate boom section 18 and the tip boom section 20 are substantially similar to the base boom section, as described, and corresponding parts of these boom sections are identified with the same reference numeral having suffixed I and T. It will be noted, in FIG. 2, that the intermediate boom section has a double plate 44 backing up the plate 34I and a corresponding double plate 45 backing up the plate 35I. Each double plate extends between the vertical depending flange of a top angle chord 28I or 29I and the horizontally extending flange of a bottom angle chord 30I or 31I, in a position contacting the shaped portion interior panels 41I of the plates 34I and 35I. An opening 46T, shown more clearly in FIG. 3, is provided in each shaped portion interior panel 41T of the plate 34T, and similar openings are provided in plate 35T. Also, as shown in FIG. 2, similar openings 46I are provided in the interior panels of plates 34I and 35I, and similar opening 46D are provided in the double plates 44 and 45.

Looking again at FIG. 2, an edge distance e is shown between an edge joint weld 48, along either the top edge or the bottom edge of the web or side plate 35, and the nearest adjacent portion of a shaped portion 40. This edge distance should be large enough to enable the web or side plate to bend smoothly therebetween, in a lateral direction, with an arc of large radius, but the edge distance should be short enough, in relationship to the thickness of the plate, to provide resistance to buckling. An edge distance of between 1½ to 2 inches has been found to be satisfactory for a web plate having a thickness of 3/16 of an inch, a depth of up to 29½ inches, and diamond shaped portions 40, as shown.

Now looking again at FIG. 3, the interior panel 41T has a flange width *w*, between the outermost edge of the laterally projecting shaped portion 40T and the central opening 46T within the interior panel, to stiffen the shaped portion of the web plate adjacent the central opening. A suitable flange width *w* for such stiffening has been found to be approximately 3/4 to 1 inch. A center to center spacing S between adjacent shaped portions 40T is approximately equal to the overall depth *d* of the boom section 20, in which the web plate 34T is located, divided by the tangent of the angle *a*. This angle is the included angle between a bottom edge 50 of the boom section 20 and a diagonal line that is parallel to a straight side edge of a shaped portion's diamond-shaped base. The bottom edge of the boom section is parallel to the top edge 36T and the bottom edge 37T of the web plate. When the angle *a* is approximately 60°, the angularity of the remaining portion of the web 34T between adjacent shaped portions 40T enables an even distribution of radial bending stress caused by horizontal shear in that portion of the web plate.

The shaped portions 40T are of a uniform size and with the designated center to center spacing S, a sufficent spacing between shaped portions, or width of web plate, remains to reduce the stress concentrations at central locations between the top and bottom edges of the web plate. Preferably, the spacing SP between a straight side edge of one shaped portion's diamond-shaped base and a line parallel thereto extended from a straight side edge of an adjacent shaped portion's diamond-shaped base is about 1 inch.

The webs or side plates 34, 35 are made of thin high formability steel and the shaped portions 40 are fromed therein with dies. The central openings, such as 46T, are blanked or cut from the interior panels of the shaped portions. Since the shaped portions provide good buckling resistance, a thinner web plate can be used and this reduces the weight of the plate. Also, the central openings, that are cut in the interior panels of the shaped portions where metal is not necessary, further reduce the weight of the web plates.

Figure 4:
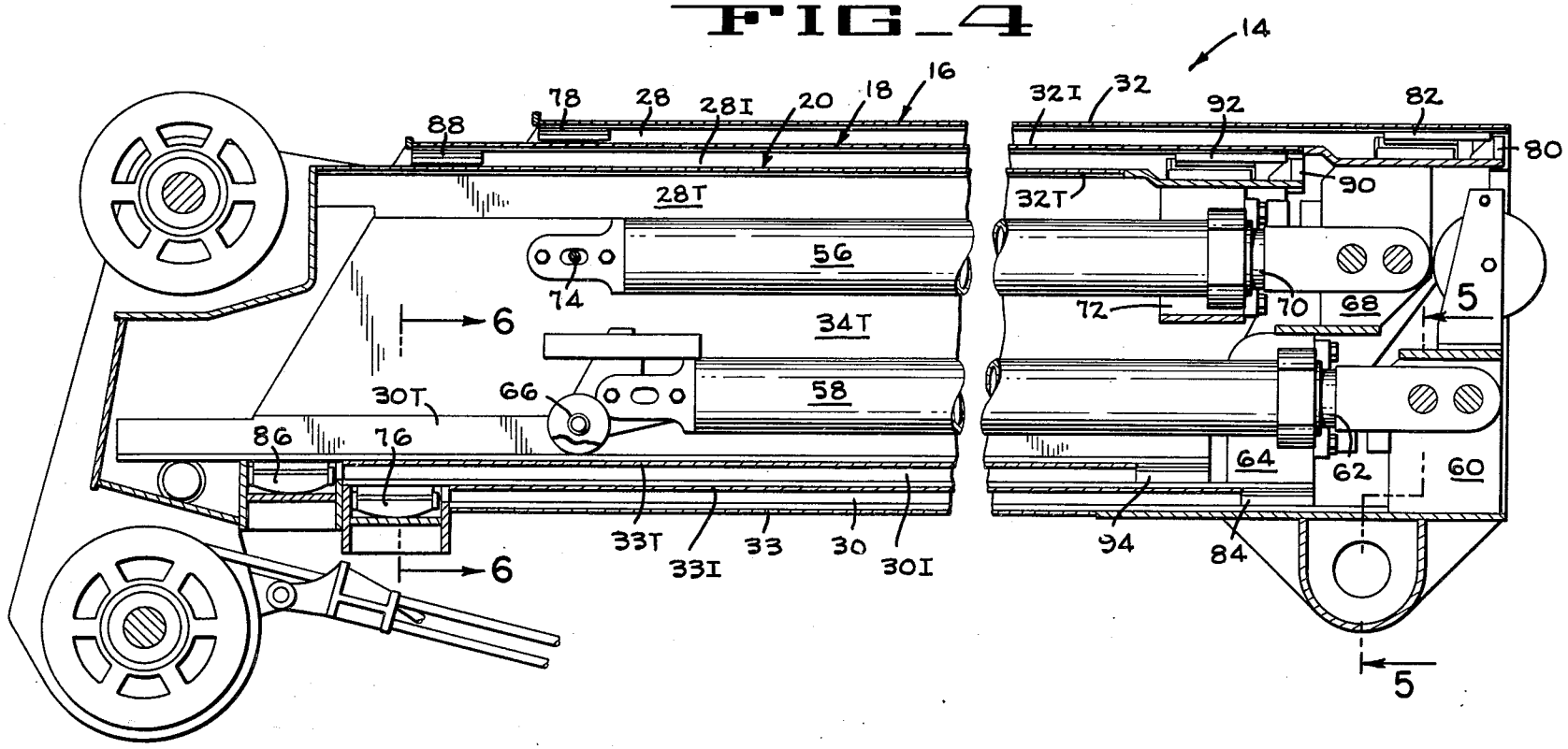
FIG. 4 is a broken longitudinal section of the boom assembly, shown in FIG. 1.

Looking now at FIG. 4, the extensible boom assembly 14 can be extended or retracted by a hydraulic cylinder 56 and by a hydraulic cylinder 58. A mount 60, that is attached to the base boom section 16, has the extending end of an actuating arm 62 pinned thereto. This actuating arm extends from the hydraulic cylinder 58 that is mounted, at one end, by a bracket 64 to the intermediate boom section 18 and supported, at the opposite end, by a roller assembly 66 within the tip boom section 20. Upon extension of the actuating arm 62 from the hydraulic cylinder 58, the intermediate boom section is extended from the base boom section. A mount 68, that is attached to the intermediate boom section, has an actuating arm 70 pinned thereto. This actuating arm extends from the hydraulic cylinder 56 that is mounted, by a bracket 72 and by a pin 74, to the tip boom section. Upon extension of the actuating arm 70 from the hydraulic cylinder 56, the tip boom section is extended from the intermediate boom section.

The telescoping boom sections 16, 18 and 20 are supported for relative slidable movement between sections. A pair of front shoe assemblies 76 are mounted, within the base boom section 16 at the lower front end thereof, to support chord angles 30I and 31I, as shown in FIG. 6. A pair of bumper pads 78, shown in FIG. 4, are mounted at the upper front end of the base boom section and a pair of stops 80 are mounted at the upper rear end of the base boom section to limit the travel of a pair of shoe assemblies 82. These assemblies are mounted at the upper rear end of the intermediate boom section 18. A pair of bumper pads 84 are provided at the lower rear end of the intermediate boom section, and these bumper pads engage the shoe assemblies 76 when the intermediate boom section is extended.

A pair of front shoe assemblies 86 are mounted within the intermediate boom section 18, at the lower front end thereof, to support the tip boom section 20. A pair of bumper stops 88 are mounted at the upper front end of the intermediate boom section, and a pair of stops 90 are mounted at the upper rear end of the intermediate boom section to limit travel of a pair of shoe assemblies 92 that are mounted at the upper rear end of the tip boom section. A pair of bumper pads 94 are provided at the lower rear end of the tip boom section, and these bumper pads engage the front shoe assemblies 86 when the tip boom section is extended.

As the intermediate boom section 18 is extended from the base boom section 16, the shoe assemblies 76 place a concentrated reaction load at intermediate points along the bottom of the boom section, from near the shoe assemblies 86 to the bumper pads 84. A concentrated load is applied to the front end of the intermediate boom section fat the shoe assemblies 86, and another concentrated load is applied to the rear end of the intermediate boom section, at the shoe assemblies 82. As the tip boom section 20 is withdrawn from the intermediate boom section, the shoe assemblies 92 place a concentrated reaction load at intermediate points along the top of the boom section, to the bumper pad 88. Because of these concentrated loads that can vary in position along the length of the intermediate boom section, it is necessary to provide the double plates 44 and 45 that back up the web or side plates 34I and 35I. These double plates prevent the angle chords from twisting due to eccentric loading. The double plates, together with the web plates, form a double wall that has good resistance to buckling, and these plates add considerably to the section modulus of the intermediate boom section.

It should be noted that the transverse sections of the boom sections 16, 18 and 20, shown in FIG. 5, do not appear exactly as shown in other views, due to the fact that the rearmost ends of the sections have stiffening frames, to provide resistance to the high concentrated shoe loads.

Thus, the present invention provides an extensible crane boom assembly having web plates therein that are strong, stiff, light in weight, and particularly suitable for high concentrated loads. The arrangement of the boom sections, that include angle chords held in spaced relationship by thin plates, positions the main steel at the extreme corners of the boom to yield maximum strength with minimum weight. The angle chords have sufficient rigidity to spread the local shoe reactions over a large area, and the web plates are stiffened by the shaped portions therein, to resist buckling. The portions of the web plate remaining between adjacent shaped portions transfer stress between the top and bottom edges of the web plate. The shaped portion's size and shape, the center to center spacing between shaped portions, the edge distance from a shaped portion to an edge joint weld along either the top or the bottom edge of the web plate, and the interior panel flange width to the central opening, all provide for strengthening a thin plate so as to serve as a web plate, in an extensible crane boom assembly.

Although the best mode contemplated for carrying out the present invention has been herein shown and described, it will be understood that modification and variation may be made without departing from what is regarded to be the subject matter of the invention.

What is claimed is:

1. An extensible crane boom assembly having telescopically interfitting boom sections that include a base section, an intermediate section slidably fitted within the base section, and a top section slidably fitted within the intermediate section; each boom section having four elongated angle chords with normally disposed flanges that are positioned to define the longitudinal corner edges of a box-like configuration, and four elongated plates extending between adjacent angle chords and welded thereto to form the sides, top and bottom of the boom section; each of said elongated plates which form the side webs of the boom section being of uniform thickness and having a top edge, a bottom edge, a pair of side surfaces that are located in spaced apart parallel planes at the juctures of the side surfaces with said top and bottom edges, and a plurality of shaped portions being formed within the plates at locations intermediate the top and bottom edges to space those portions of the plate laterally from said parallel planes, said shaped portions being located at spaced intervals longitudinally of the plate, each shaped portion having a regular geometrical pattern that forms a laterally projecting protuberance on one side of the plate and a corresponding depression on the opposite side of the plate, said shaped portion geometrical pattern being a frustum of a pyramid with a generally diamond-shaped base thereby stiffening the plate between adjacent shaped portions and between these shaped portions and adjacent top and bottom edges of the plate to resist buckling, said plate between adjacent shaped portions having side surfaces within the parallel planes from the top edge to the bottom edge of the plate and providing longitudinal spacing between parallel diagonal lines that coincide with adjacent edges of adjacent shaped portions, each of said shaped portions having an interior panel that is offset from and parallel with the spaced apart parallel planes, some of said interior panels having central openings therein to reduce the weight of the plate.

2. The assembly described in claim 1 wherein the flange width of the interior panel between the outermost edge of the laterally projecting shaped portion and the central opening therein is sufficient to stiffen the web plate adjacent the central opening.

3. The assembly as described in claim 1 wherein the flange width of the interior panel is between ¾ to 1 inch.

4. An extensible crane boom assembly having telescopically interfitting boom sections that include a base section, an intermediate section slidably fitted within the base section, and a top section slidably fitted within the intermediate section; each boom section having four elongated angle chords with normally disposed flanges that are positioned to define the longitudinal corner edges of a box-like configuration, and four elongated plates extending between adjacent angle chords and welded thereto to form the sides, top and bottom of the boom section; each of said elongated plates which form the side webs of the boom section being of uniform thickness and having a top edge, a bottom edge, a pair of side surfaces that are located in spaced apart parallel planes at the junctures of the side surfaces with said top and bottom edges, and a plurality of shaped portions being formed within the plates at locations intermediate the top and bottom edges to space those portions of the plate laterally from said parallel planes, said shaped portions being located at spaced intervals longitudinally of the plate, each shaped portion having a regular geometrical pattern that forms a laterally projecting protuberance on one side of the plate and a corresponding depression on the opposite side of the plate, said shaped portion geometrical pattern being a frustum of a pyramid with a generally diamond-shaped base thereby stiffening the plate between adjacent shaped portions and between these shaped portions and adjacent top and bottom edges of the plate to resist buckling, said plate between adjacent shaped portions having side surfaces within the parallel planes from the top edge to the bottom edge of the plate and providing longitudinal spacing between parallel diagonal lines that coincide with adjacent edges of adjacent shaped portions, each of said shaped portions having an interior panel that is offset from and parallel with the spaced apart parallel planes, some of said shaped portions in the intermediate boom section and in the tip boom section having central openings within the interior panel to reduce the weight of the plates forming the sides of the boom sections, and said shaped portions in the base section having solid interior panels to protect interior components of the boom assembly during storage.

* * * * *